US005434472A

United States Patent [19]

van den Boom

[11] Patent Number: 5,434,472

[45] Date of Patent: Jul. 18, 1995

[54] HIGH-PRESSURE SODIUM DISCHARGE LAMP WITH GETTER

[75] Inventor: Petrus F. J. van den Boom, Eindhoven, Netherlands

[73] Assignee: United States Philips Corporation, New York, N.Y.

[21] Appl. No.: 28,461

[22] Filed: Mar. 9, 1993

[30] Foreign Application Priority Data

Apr. 15, 1992 [EP] European Pat. Off. ..... 92201083

[51] Int. Cl.[6] ..... H01J 17/24

[52] U.S. Cl. ..... 313/561; 313/25; 313/331; 313/570; 313/635; 313/634; 313/635; 313/638; 315/246; 252/181.3; 252/181.4; 252/181.6

[58] Field of Search ..... 313/25, 331, 570, 635, 313/634, 625, 561, 638; 315/246, 326; 252/181.3, 181.4, 181.6

[56] References Cited

U.S. PATENT DOCUMENTS

| | | | |
|---|---|---|---|
| 4,221,989 | 9/1980 | Van Kieshout | 313/331 |
| 4,490,642 | 12/1984 | Dobrusskin et al. | 313/25 |
| 4,527,097 | 6/1985 | van der Heijden et al. | 315/246 |
| 4,736,136 | 4/1988 | Persiani et al. | 313/635 |
| 4,859,905 | 8/1989 | White et al. . | |
| 4,868,463 | 9/1989 | Dorleijn et al. | 315/326 |
| 4,977,346 | 12/1990 | Gibson et al. | 313/25 |
| 5,008,583 | 4/1991 | Carleton | 313/25 |
| 5,015,913 | 5/1991 | Pfaue | 313/625 |
| 5,097,176 | 3/1992 | DeHair et al. | 313/570 |
| 5,153,482 | 10/1992 | Keijser et al. | 313/634 |

OTHER PUBLICATIONS

"The High-Pressure Sodium Lamp", by J. J. de Groot and J. A. J. M. van Vliet, Philips Technical Library, Kluwer Technischeboeken B.V.—Deventer Antwerpen, The Netherlands. Apr. 22, 1986.

*Primary Examiner*—Sandra L. O'Shea
*Assistant Examiner*—Ali Horri
*Attorney, Agent, or Firm*—Brian J. Wieghaus

[57] ABSTRACT

The invention relates to a high-pressure sodium discharge lamp provided with a discharge vessel (3) with a ceramic wall (3*a*) of aluminum oxide in which at least Na as an ionizable filling component, a rare gas and Al (20) are present. According to the invention, the Al is provided near the wall of the discharge vessel in a location which reaches a temperature of at least 1000 K in the operational condition of the lamp.

19 Claims, 2 Drawing Sheets

HIGH-PRESSURE SODIUM DISCHARGE LAMP WITH GETTER

BACKGROUND OF THE INVENTION

The invention relates to a high-pressure sodium discharge lamp provided with a discharge vessel with a ceramic wall of aluminum oxide in which at least Na as an ionizable filling component, a rare gas and Al are present, and provided with main electrodes between which a discharge takes place in the operational condition.

A lamp of the kind mentioned in the opening paragraph is known from U.S. Pat. No. 4,859,905. In the known lamp, the At is fastened to an electrode rod in the form of a Zr-Al alloy. The At then functions as a getter for free $O_2$ which is evolved or present as an impurity in the discharge vessel. This is important because free $O_2$ in the discharge vessel leads to the formation of sodium aluminate via the intermediary of NaO, so that Na as an ionizable filling component disappears. It is of great importance to counteract Na-disappearance in all those cases in which the Na is present in the discharge vessel in only a small excess quantity or even not in excess at all. However, besides Na-disappearance owing to free $O_2$, Na-disappearance owing to direct chemical reactions between Na and wall material $Al_2O_3$ takes place as well, leading to the formation of sodium aluminate. The measure taken in the known lamp, however, has no noticeable influence on these forms of Na-disappearance.

SUMMARY OF THE INVENTION

It is an object of the invention inter alia to provide a measure to counteract Na-disappearance caused by direct reactions with the wall alumina in lamps of the kind mentioned in the opening paragraph.

According to the invention, a lamp of the kind mentioned in the opening paragraph is for this purpose characterized in that the Al is provided near the wall of the discharge vessel in a location which reaches a temperature of at least 1000 K in the operational condition of the lamp.

It was found that the described measure according to the invention counteracts Na-disappearance caused by reactions with wall alumina to a very high degree. Reactions may even be effectively blocked in lamps having a temperature of the coldest spot of more than 1000 K, provided the partial Al pressure is higher than the equilibrium pressure belonging to the sodium-aluminate-forming reactions at the prevailing temperature and Na pressure. This is especially the case in unsaturated lamps in which the Na pressure is determined by the general gas law, and accordingly by the average temperature in the discharge vessel.

A high-pressure sodium discharge lamp is considered to have an improved colour rendering if the light radiated by the lamp has a colour rendering which expressed as the colour-rendering index $R_a$ has a value of at least 60.

"White" light, in the case of light radiated by a high-pressure sodium lamp, can generally be defined as light lying in the region of the chromaticity diagram bounded by straight lines through points having coordinates (x; y); (0,400; 0,430), (0,510; 0,430), (0,485; 0,390) and (0,400; 0,360). The colour temperature $T_c$ then lies between approximately 2300 K and 4000 K. A high-pressure sodium lamp radiating white light can serve as a replacement for an incandescent lamp, for example, in accent lighting applications. A colour rendering index $R_a$ above 80 is necessary for an incandescent lamp replacement. The maximum achievable value for the colour rendering index lies between 80 and approximately 85 for practical high-pressure sodium lamps.

A high-pressure sodium discharge lamp radiates light with a spectrum characterized by an absorption band near 589 nm flanked by spectral flanks with maxima at a mutual interspacing $\Delta\lambda$. The value of the interspacing $\Delta\lambda$ determines both the value of the colour rendering index $R_a$ and the colour temperature $T_c$, i.e. the relevant coordinates in the chromaticity diagram.

There is a direct relation between $\Delta\lambda$ and the Na pressure, described inter alia in J. J. de Groot and H. A. J. M. van Vliet, "The high-pressure sodium lamp", 1986. The prevailing Na pressure in the lamp can accordingly be determined through measurement of $\Delta\lambda$.

Saturated high-pressure sodium lamps for general applications have an Na pressure corresponding to that of a spot of lowest temperature, between approximately 800 K and 1000 K, in the operational condition of the lamp. The saturation pressure of Al belonging to these temperatures is lower than the Al equilibrium pressure prevailing in sodium-aluminate-forming reactions, so that Al condensation will take place near the coldest spot in these lamps when the invention is applied. The measure according to the invention, therefore, will not lead to blocking of sodium-aluminate-forming reactions under these circumstances, but it will be capable of delaying them to a considerable extent, so that a substantial lengthening of lamp life can be realised. This is an important advantage of the measure according to the invention especially for those lamps which comprise exclusively Na as an ionizable filling component, because it was found that in these lamps reactions leading to Na-disappearance proceed more quickly than in comparable lamps which also comprise Hg as an ionizable filling component.

Preferably, the Al is provided near a portion of the wall which is situated between the main electrodes. This has the advantage that this portion of the wall assumes the highest wall temperature during lamp operation and that as a result a comparatively high partial Al pressure is realised. This is especially important for counteracting the formation of sodium aluminate with $\beta$- and $\beta''$-aluminate structure ($NaAl_{11}O_{17}$, $NaAl_5O_8$). The formation of aluminates having a $\beta$- and $\beta''$-structure is strongly dependent on the prevailing temperature and is found to be hardly in evidence below 1350 K, in contrast to so-called mono-Na-aluminate ($NaAlO_2$) which is formed to a considerable degree already at a temperature of 800 K. At temperatures from 1350 K upwards the formation speed of $\beta$- and $\beta''$-aluminates increases strongly. Compared with all Na pressure conditions which could occur in high-pressure sodium lamps, the partial Al equilibrium pressures of the $\beta$- and $\beta''$-aluminate forming processes lie comparatively high. Positioning the AI near the hottest portion of the wall, and thus the creation of a comparatively high local AI pressure, therefore, is favourable for counteracting the formation of $\beta$- and $\beta''$-aluminates. Not only does this lead to an improved lamp life, but it also affords the lamp designer a greater freedom of choice as regards lamp parameters, especially the desired wall load and the maximum wall temperature related thereto. In general, the latter will be chosen to be not higher than 1600

K in view of the temperature resistance of the ceramic wall material itself.

It is advantageous for a simple lamp manufacture that the aluminium is fixed to the wall of the discharge vessel by means of fusion. The Al may then be present in the discharge vessel in the form of a piece of wire or a pellet which is fused against the wall of the discharge vessel by short external heating.

BRIEF DESCRIPTION OF THE DRAWINGS

The described aspects and other aspects of the invention will be explained in more detail with reference to a drawing, in which.

DESCRIPTION OF THE PREFERRED EMBODIMENTS

Figure 1:
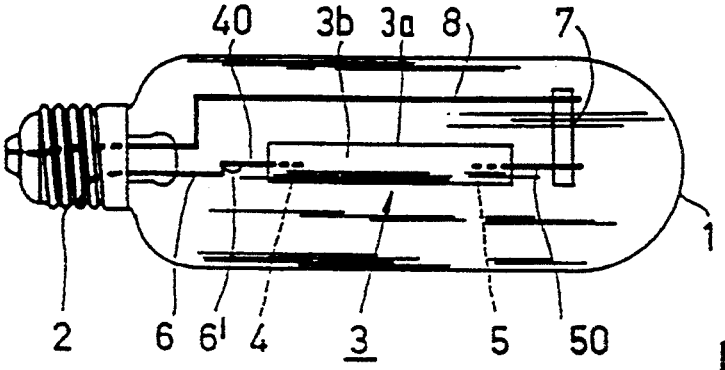
FIG. 1 shows a lamp according to the invention, FIG. 2 gives a detailed cross-sectional view of a portion of the lamp of FIG. 1, FIG. 3*a* gives the results of an investigation into the sodium aluminate formation in a lamp according to the invention, FIG. 3*b* gives the results of an investigation into the sodium aluminate formation in a comparison lamp without Al near the wall, and FIG. 4 gives the results of spectrum measurements of a lamp according to the invention and a comparison lamp.
Figure 2:
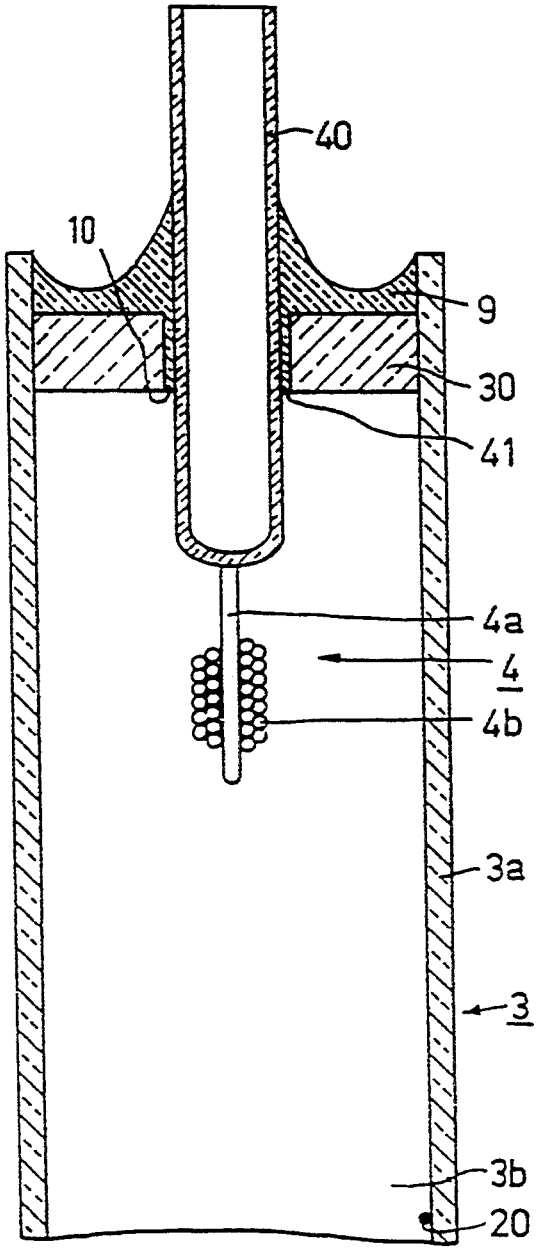

FIG. 1 shows a high-pressure sodium discharge lamp according to the invention provided with a discharge vessel 3 enclosing a discharge space 3*b* with a ceramic wall 3*a* of aluminium oxide, in which at least Na as an ionizable filling component, a rare gas and Al are present. The lamp is provided with main electrodes 4, 5 arranged in the discharge space 3*b* , between which electrodes a discharge takes place in the operational condition. The main electrodes 4, 5 are each connected to a respective current lead-through member 40, 50, each current lead-through member being passed through the wall 3*a* of the discharge vessel 3 and being connected thereto in a gastight manner by means of a melting-ceramic connection 9 (FIG. 2). The lamp is also provided with an outer bulb 1 and a lamp cap 2. Lead-through member 40 is electrically connected to a rigid current conductor 6, which is internally connected to the lamp cap 2, via a flexible conductor 6'. Lead-through member 50 is electrically and mechanically connected via an auxiliary conductor 7 to a rigid current conductor 8 which is also internally connected to the lamp cap 2.

FIG. 2 shows in detail part of the construction of the discharge vessel 3 including the current lead-through member 40. The current lead-through member 40 is passed through the ceramic wall 3*a* at the area of a ceramic sealing plug 30 which forms part of this ceramic wall. A main electrode 4 consisting of an electrode rod 4*a* and electrode windings 4*b* is fastened to the lead-through element 40.

An Al pellet 20 is fixed to a portion of the wall 3*a* situated between the electrodes 4, 5 by means of fusion.

A practical embodiment of the described lamp with a rated power of 250 W was an unsaturated high-pressure sodium lamp which comprised besides Na also Hg as an ionizable filling component. Both Na and Hg are fully in the vapour phase in the operational condition of the lamp. Xe was present in the discharge vessel as the rare gas with a pressure of 260 mbar. The Al was provided in the discharge vessel in the form of a piece of wire of 350 $\mu$g with a diameter of 150 $\mu$m and a length of 7 mm, and fixed to the wall by fusion.

In the operational condition of the lamp, $\Delta\lambda$ was 35 nm, which corresponds to an Na pressure of approximately 45 kPa. The temperature of the coldest spot is 1050 K. The maximum wall temperature is 1410 K. The light radiated by the lamp has a colour temperature $T_c$ of 2350 K. The general colour rendering index $R_a$ then lies between 70 and 75.

For comparison, no Al was provided in the discharge vessel near the wall in a lamp which was identical in all other respects. Both lamps were operated for 1200 h, after which the discharge vessel wall of each lamp was investigated for the presence of Na in the form of mono-Na-aluminate and of Na-aluminate with $\beta$- and $\beta''$-structure. This investigation was carried out in that, after removal of the Na-Hg amalgam, the quantity of Na in the form of mono-Na-aluminate was ascertained by Atomic Absorption Spectroscopy. The Na is also removed from the mono-Na-aluminate by dissolution. Then the remaining quantity of Na, accordingly that which is derived from Na-aluminate with $\beta$- and $\beta''$-structure, is ascertained by means of Neutron Activation Analysis. The discharge vessel wall is longitudinally divided into 7 portions for this purpose. The results are given in FIG. 3; in FIG. 3*a* for the lamp according to the invention and in FIG. 3*b* for the comparison lamp.

In FIG. 3, the discharge vessel portions are indicated on a horizontal axis with the letters A to G. The portions A and G are the wall portions at the level of the ceramic sealing plugs. The portions B to F are wall portions of mutually equal size situated between the ceramic sealing plugs.

The quantity of Na found in the Na-aluminate present is indicated in the form of bars for each wall portion in relative units, the bar indicating Na in the form of mono-Na-aluminate being hatched and the bar indicating Na in the form of $\beta$- and $\beta''$-Na-aluminate being dotted.

Figure 3A:
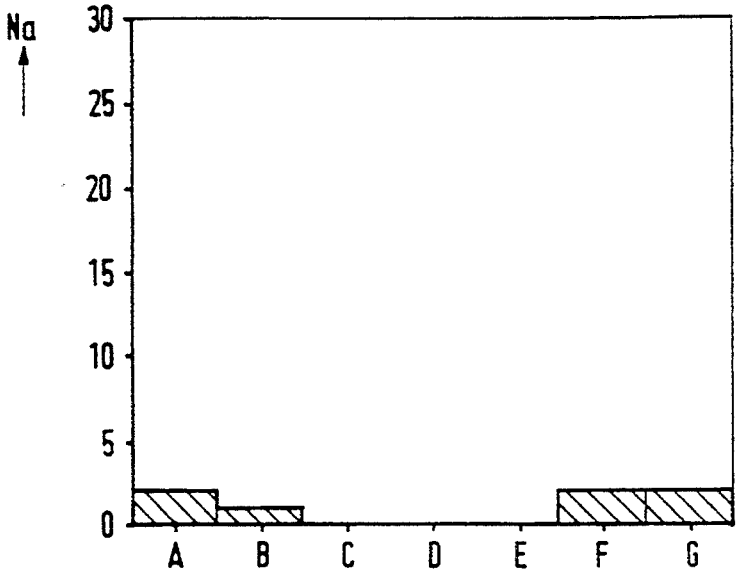
Figure 3B:
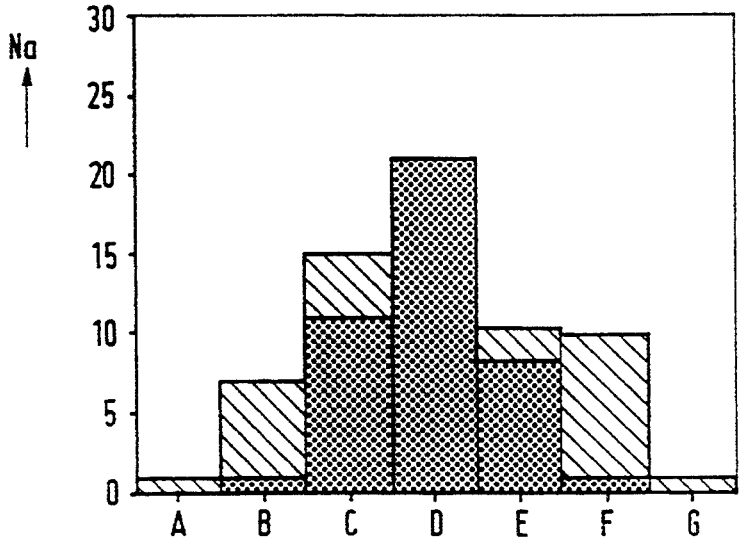

A comparison of the results of FIG. 3*a* and of FIG. 3*b* shows that the presence of Al completely prevents the formation of Na-aluminate with $\beta$- and $\beta''$-aluminate structure and counteracts the formation of other types of Na-aluminate to a very great extent.

Another practical embodiment of the described lamp, with a rated power of 215 W, was an unsaturated high-pressure sodium lamp with a $\Delta\lambda$ value of 32 nm, corresponding to an Na pressure during lamp operation of approximately 40 kPa. The temperature of the coldest spot is 1140 K, heat shields of Ta being used around the discharge vessel ends, each shield approximately 10 mm high.

The discharge vessel comprises besides Na also Hg, Xe with a filling pressure of 260 mbar, and a piece of Al wire weighing 350 $\mu$g which is fixed to the discharge vessel wall by fusion.

The $\Delta\lambda$ value in the spectrum of the light radiated by the lamp was measured at intervals. The $\Delta\lambda$ value of the light spectrum of an identical lamp, but without Al near the wall, was measured for comparison.

Figure 4:
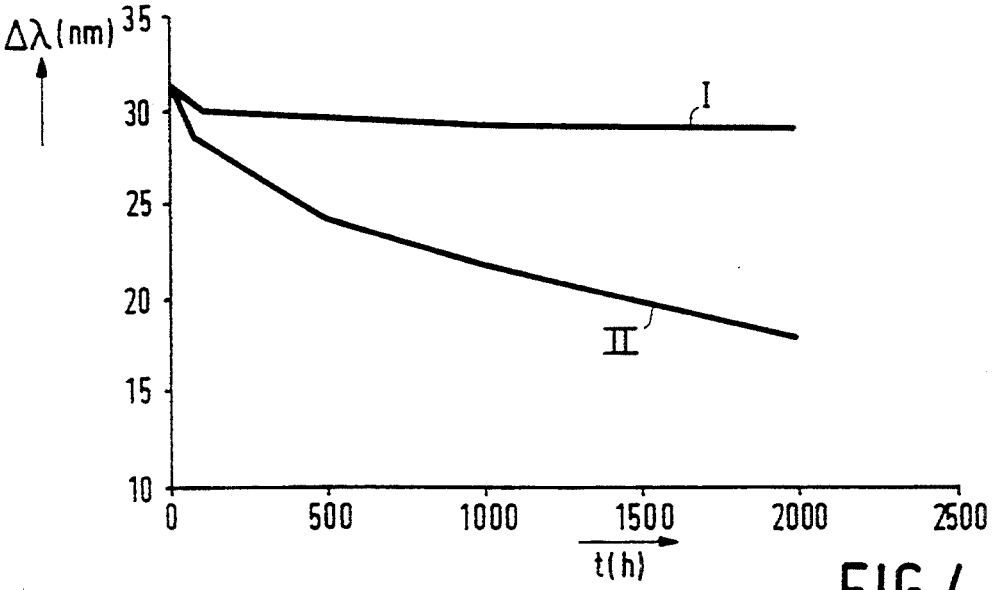

The results are given in FIG. 4, where curve I relates to the lamp according to the invention and curve II relates to the comparison lamp without Al near the discharge vessel wall.

Inspection of the curves shows that Na-disappearance, and therefore the formation of mono, $\beta$-, and $\beta''$-Na-aluminate has been almost completely counteracted in the lamp according to the invention. This may be explained from the following generally known principle as described inter alia in J. J. de Groot and J. A. J. M. van Vliet, "The high-pressure sodium lamp", 1986. A high-pressure sodium discharge lamp emits light with a spectrum characterized by an absorption band near 589 nm flanked by spectral flanks with maxima having a mutual interspacing $\Delta\lambda$. There is a relation between the interspacing $\Delta\lambda$ and the prevailing Na pressure, the interspacing being smaller in proportion as the prevailing Na pressure is lower. The interspacing $\Delta\lambda$ may be conceived as being built up from a proportion $\Delta\lambda_B$ situated between the wavelength of 589 nm and the maximum of the spectral flank at the short-wave side of the absorption band. There is a similar relation between $\Delta\lambda_B$ and the Na pressure as between $\Delta\lambda$ and the Na pressure. This renders it possible to ascertain to what extent Na losses occur in that the value of $\Delta\lambda$ or $\Delta\lambda_B$ is measured for a lamp at intervals during its life. In a gastight discharge vessel, which is a strict precondition for an operating lamp, Na-losses can only be explained from a lack of Na-resistance of one or several of the components: ceramic wail, current lead-through member, melting-ceramic connection, and electrode. Since the only difference between the lamps investigated was the presence of Al near the wail, a comparison of the occurring changes in the measured values of $\Delta\lambda$ or $\Delta\lambda_B$ is a reliable means of ascertaining the difference in formation of Na-aluminate.

I claim:

1. A high-pressure sodium discharge lamp having a discharge vessel with a ceramic wall which includes aluminum oxide and in which at least Na as an ionizable filling component, a rare gas and Al are present, and means for maintaining a discharge within said discharge vessel in the operational condition of the lamp, wherein the improvement comprises:

the Al is disposed near the wall of the discharge vessel in a location which reaches a temperature of at least 1000 K in the operational condition of the lamp.

2. A lamp as claimed in claim 1, characterized in that the Al is disposed near a portion of the wail which is situated between the main electrodes.

3. A lamp as claimed in claim 2, characterized in that the aluminium is fused to the wail of the discharge vessel.

4. A lamp as claimed in claim 3, characterized in that the Al is present in the discharge vessel as one of (i) a piece of wire and (ii) a pellet.

5. A lamp as claimed in claim 2, characterized in that the Al is present in the discharge vessel as one of (i) a piece of wire and a (ii) a pellet.

6. A lamp as claimed in claim 1, characterized in that the Al is present in the discharge vessel as one of (i) a piece of wire and a (ii) a pellet.

7. A lamp as claimed in claim 1, characterized in that the aluminum is fused to the wall of the discharge vessel.

8. A lamp as claimed in claim 7, characterized in that the Al is present in the discharge vessel as one of (i) a piece of wire and a (ii) a pellet.

9. A lamp as claimed in claim 1, wherein said ceramic wall consists essentially of aluminum oxide.

10. A lamp as claimed in claim 1, wherein said means for maintaining a discharge comprises a pair of opposing discharge electrodes.

11. A lamp as claimed in claim 1, wherein said Al is disposed at a wall location at which the wall reaches a temperature of at least 1350 K during lamp operation.

12. A high pressure discharge lamp, comprising:

a) a discharge vessel including a ceramic wall consisting of aluminum oxide and which is sealed in a gas tight manner;

b) a filling within said discharge vessel comprising Na as an ionizable component and a rare gas;

c) a pair of discharge electrodes within said discharge vessel between which a gas discharge is maintained during lamp operation, said ceramic wall including a location at which the wall temperature is at least 1000 K during lamp operation; and d) a mass of Al fixed to said ceramic wall at said location where said wall temperature is at least 1000 K during lamp operation for suppressing sodium-aluminate-forming reactions.

13. A lamp according to claim 12, wherein said mass of Al is fixed to said ceramic wall at a location where said ceramic wall reaches a temperature of at least 1350 K during lamp operation for suppressing the formation of sodium aluminate with $\beta$- and $\beta''$- aluminate structures ($NaAl_{11}O_{17}$,$NaAl_5O_8$).

14. A lamp as claimed in claim 13, characterized in that the Al is disposed near a portion of the wall which is situated between the main electrodes.

15. A lamp as claimed in claim 13, characterized in that the Al is fused to the wall of the discharge vessel.

16. A lamp as claimed in claim 13, characterized in that the Al is present in the discharge vessel as one of (i) a piece of wire and (ii) a pellet.

17. A lamp as claimed in claim 12, characterized in that the Al is disposed near a portion of the wall which is situated between the main electrodes.

18. A lamp as claimed in claim 12, characterized in that the Al is fused to the wall of the discharge vessel.

19. A lamp as claimed in claim 12, characterized in that the Al is present in the discharge vessel as one of (i) a piece of wire and (ii) a pellet.

* * * * *